US006439981B1

(12) United States Patent
Pallinti et al.

(10) Patent No.: US 6,439,981 B1
(45) Date of Patent: Aug. 27, 2002

(54) ARRANGEMENT AND METHOD FOR POLISHING A SURFACE OF A SEMICONDUCTOR WAFER

(75) Inventors: Jayanthi Pallinti, Santa Clara; Ron Nagahara, San Jose, both of CA (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/750,639

(22) Filed: Dec. 28, 2000

(51) Int. Cl.[7] ..... B24B 1/00
(52) U.S. Cl. ..... 451/287; 451/5; 451/288
(58) Field of Search ..... 451/287, 5, 288

(56) References Cited

U.S. PATENT DOCUMENTS 5,653,624 A * 8/1997 Ishikawa et al. ..... 451/288 X
5,655,954 A * 8/1997 Oishi et al. ..... 451/287 X
5,816,900 A 10/1998 Nagahara et al.
5,835,226 A 11/1998 Berman et al.
5,863,825 A 1/1999 Pasch et al.
5,865,666 A 2/1999 Nagahara
5,868,608 A 2/1999 Allman et al.
5,871,393 A * 2/1999 Shiozawa ..... 451/287 X
5,882,251 A 3/1999 Berman et al.
5,888,120 A 3/1999 Doran
5,893,756 A 4/1999 Berman et al.
5,931,719 A 8/1999 Nagahara et al.
5,941,761 A 8/1999 Nagahara et al.
5,944,585 A 8/1999 Nagahara et al.
5,957,757 A 9/1999 Berman
5,961,375 A 10/1999 Nagahara et al.
5,975,994 A * 11/1999 Sandhu et al. ..... 451/287 X
5,985,679 A 11/1999 Berman
5,990,010 A 11/1999 Berman
6,066,266 A 5/2000 Osugi et al.
6,069,085 A 5/2000 Berman
6,071,818 A 6/2000 Chisholm et al.
6,074,288 A 6/2000 Nagahara et al.
6,074,517 A 6/2000 Taravade
6,077,783 A 6/2000 Allman et al.
6,080,670 A 6/2000 Miller et al.
6,106,369 A * 8/2000 Konishi et al. ..... 451/287 X

* cited by examiner

*Primary Examiner*—Joseph J. Hail, III
*Assistant Examiner*—Anthony Ojini
(74) *Attorney, Agent, or Firm*—Maginot, Moore & Bowman, L.L.P.

(57) ABSTRACT

An arrangement for polishing a semiconductor wafer is disclosed. The arrangement includes a plurality of preassembled polishing pad assemblies which can be selectively coupled to, and decoupled from, an actuating mechanism for rotating the polishing pad assemblies. An associated method of polishing a semiconductor wafer is also disclosed.

8 Claims, 15 Drawing Sheets

ARRANGEMENT AND METHOD FOR POLISHING A SURFACE OF A SEMICONDUCTOR WAFER

TECHNICAL FIELD OF THE INVENTION

The present invention relates generally to an arrangement and method for polishing a surface of a semiconductor wafer. The present invention particularly relates to an arrangement and method for polishing a surface of a semiconductor wafer which includes the use of a plurality of preassembled polishing pad assemblies which can be selectively coupled to, and decoupled from, an actuating mechanism for rotating the polishing pad assemblies.

BACKGROUND OF THE INVENTION

Semiconductor integrated circuits are typically fabricated by a layering process in which several layers of material are fabricated on or in a surface of a wafer, or alternatively, on a surface of a previous layer. This fabrication process typically requires subsequent layers to be fabricated upon a smooth, planar surface of a previous layer. However, the surface topography of layers may be uneven due to an uneven topography associated with an underlying layer. As a result, a layer may need to be polished in order to present a smooth, planar surface for a subsequent processing step. For example, a layer may need to be polished prior to formation of a conductor layer or pattern on an outer surface of the layer.

In general, a semiconductor wafer may be polished to remove high topography and surface defects such as crystal lattice damage, scratches, roughness, or embedded particles of dirt or dust. The polishing process typically is accomplished with a polishing system that includes top and bottom platens (e.g. a polishing table and a wafer carrier or holder), between which a single polishing pad and the semiconductor wafer is positioned. The platens, and thus the semiconductor wafer and the polishing pad, are moved relative to each other thereby causing material to be removed from the surface of the wafer. This polishing process is often referred to as mechanical planarization (MP) and is utilized to improve the quality and reliability of semiconductor devices. The polishing process may also involve the introduction of a chemical slurry to facilitate higher removal rates, along with the selective removal of materials fabricated on the semiconductor wafer. The polishing process continues until a desired endpoint is achieved. This polishing process is often referred to as chemical mechanical planarization or chemical mechanical polishing (CMP).

However, the above described arrangement for polishing the wafer surface suffers from several drawbacks. For example, one drawback of the above described arrangement is that material removed from the wafer surface forms a "glaze" on the polishing pad. This glaze decreases the effectiveness of the pad in polishing the surface of the wafer. Mechanisms utilized to condition the pad surface, e.g. remove the glaze, are utilized but eventually the polishing pad wears out and must be replaced. Replacing the polishing pad requires a significant amount of time (e.g. several hours) during which the above described arrangement can not be utilized to polish semiconductor wafers. This downtime decreases the efficiency of the polishing arrangement, and thus increases the cost of manufacturing semiconductor wafers.

Thus, a continuing need exists for an arrangement and method which efficiently polishes a semiconductor device down to a desired polishing endpoint layer.

SUMMARY OF THE INVENTION

In accordance with one embodiment of the present invention there is provided an arrangement for polishing a surface of a semiconductor wafer. The arrangement includes a polishing pad assembly which has (i) a support member having a pad receiving surface and (ii) a polishing pad attached to the pad receiving surface. The arrangement also includes an actuating mechanism for rotating the polishing pad assembly when the polishing pad assembly is coupled to the actuating mechanism. The arrangement also includes a wafer carrier configured to receive and support the semiconductor wafer. The wafer carrier is positioned in an opposing relationship relative to the pad receiving surface when the polishing pad assembly is coupled to the actuating mechanism. The arrangement further includes an attachment mechanism operatively linked to the actuating mechanism. The attachment mechanism is selectively operable between (i) a coupling mode of operation and (ii) a decoupling mode of operation. When the attachment mechanism is operated in the coupling mode of operation the polishing pad assembly is (A) attached to the attachment mechanism and (B) coupled to the actuating mechanism. When the attachment mechanism is operated in the decoupling mode of operation the polishing pad assembly is (A) detached from the attachment mechanism and (B) decoupled from the actuating mechanism.

In accordance with another embodiment of the present invention there is provided a method of polishing a surface of a semiconductor wafer. The method includes (a) placing an attachment mechanism in a first coupling mode of operation such that a first polishing pad assembly which includes (i) a first support member having a first pad receiving surface and (ii) a first polishing pad attached to the first pad receiving surface is (A) attached to the attachment mechanism and (B) coupled to an actuating mechanism which is operatively linked to the attachment mechanism, (b) placing the first polishing pad in contact with the surface of the semiconductor wafer while the actuating mechanism rotates the first polishing pad assembly, (c) removing the first polishing pad from the surface of the semiconductor wafer, (d) placing the attachment mechanism in a decoupling mode of operation such that the first polishing pad assembly is (A) detached from the attachment mechanism and (B) decoupled from the actuating mechanism, and (e) placing the attachment mechanism in a second coupling mode of operation such that a second polishing pad assembly which includes (i) a second support member having a second pad receiving surface and (ii) a second polishing pad attached to the second pad receiving surface is (A) attached to the attachment mechanism and (B) coupled to the actuating mechanism.

In accordance with still another embodiment of the present invention there is provided an arrangement for polishing a semiconductor wafer supported on a wafer carrier. The arrangement includes a first polishing pad assembly which has (i) a first support member having a first pad receiving surface and (ii) a first polishing pad attached to the first pad receiving surface. The arrangement also includes a second polishing pad assembly which has (i) a second support member having a second pad receiving surface and (ii) a second polishing pad attached to the second pad receiving surface. The arrangement also includes an actuating mechanism for rotating the first polishing pad assembly or the second polishing pad assembly when the first polishing pad assembly or the second polishing pad assembly is coupled to the actuating mechanism. The arrangement further includes an attachment mechanism operatively linked to the actuating mechanism. The attachment mechanism is selectively operable between (i) a first coupling mode of operation, (ii) a second coupling mode of operation, and (iii) a decoupling mode of operation. When the attachment mechanism is operated in the first coupling mode of operation the first polishing pad assembly is (A) attached to the attachment mechanism and (B) coupled to the actuating mechanism. When the attachment mechanism is operated in the second coupling mode of operation the second polishing pad assembly is (A) attached to the attachment mechanism and (B) coupled to the actuating mechanism. When the attachment mechanism is operated in the decoupling mode of operation the first polishing pad assembly and the second polishing pad assembly are (A) detached from the attachment mechanism and (B) decoupled from the actuating mechanism.

It is an object of the present invention to provide a new and useful arrangement and method for polishing a surface of a semiconductor wafer.

It is also an object of the present invention to provide an improved arrangement and method for polishing a surface of a semiconductor wafer.

It is yet another object of the present invention to provide an efficient arrangement and method for polishing the surface of a semiconductor.

It is still another object of the present invention to provide an arrangement for polishing a semiconductor wafer which allows the process of replacing old worn polishing pads to occur simultaneously with the polishing process.

The above and other objects, features, and advantages of the present invention will become apparent from the following description and the attached drawings.

DETAILED DESCRIPTION OF A PREFERRED EMBODIMENT

Figure 1:
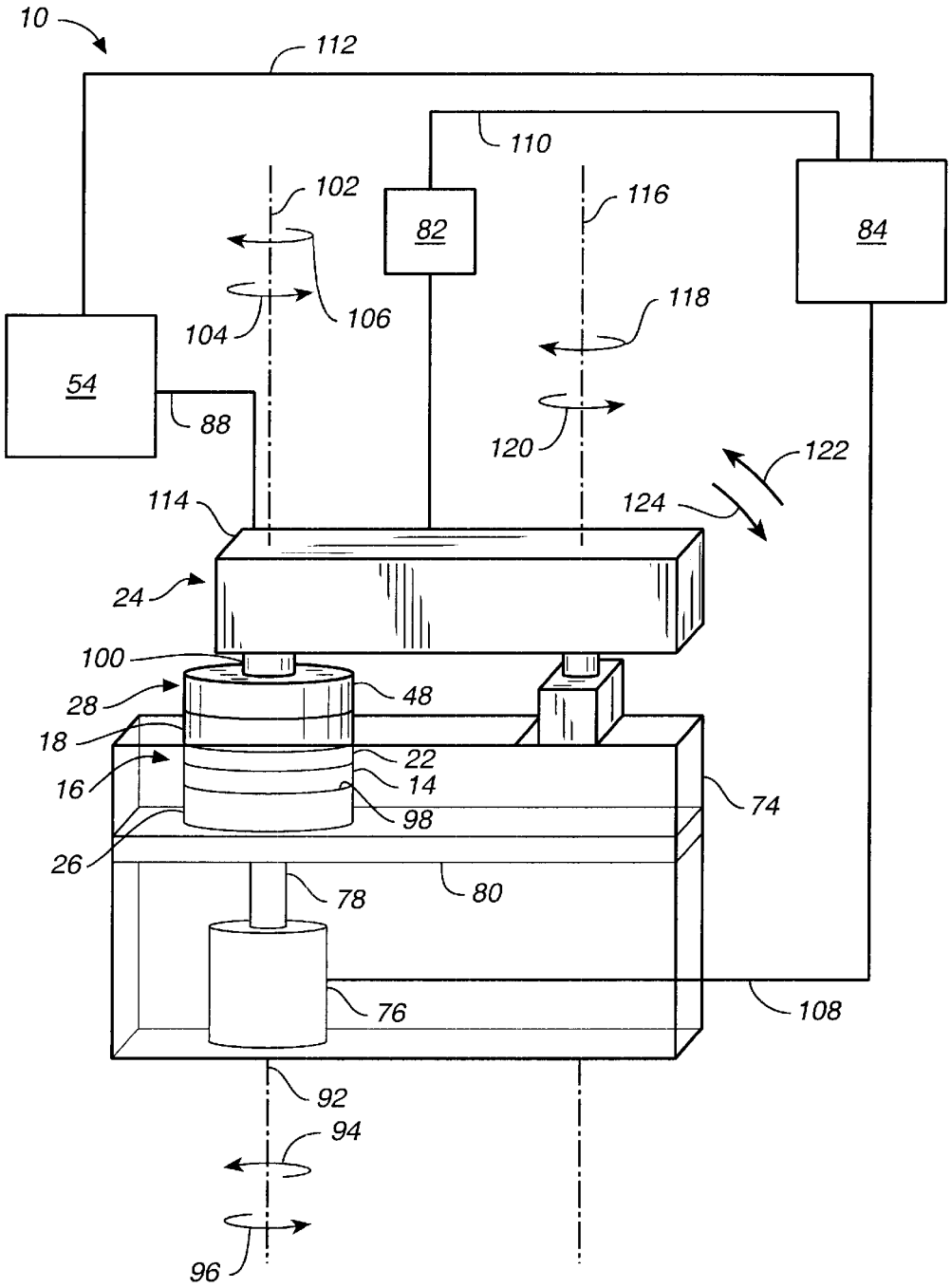
FIG. 1 is an exemplary partial schematic representation of an arrangement for polishing a surface of a semiconductor wafer which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 3A:
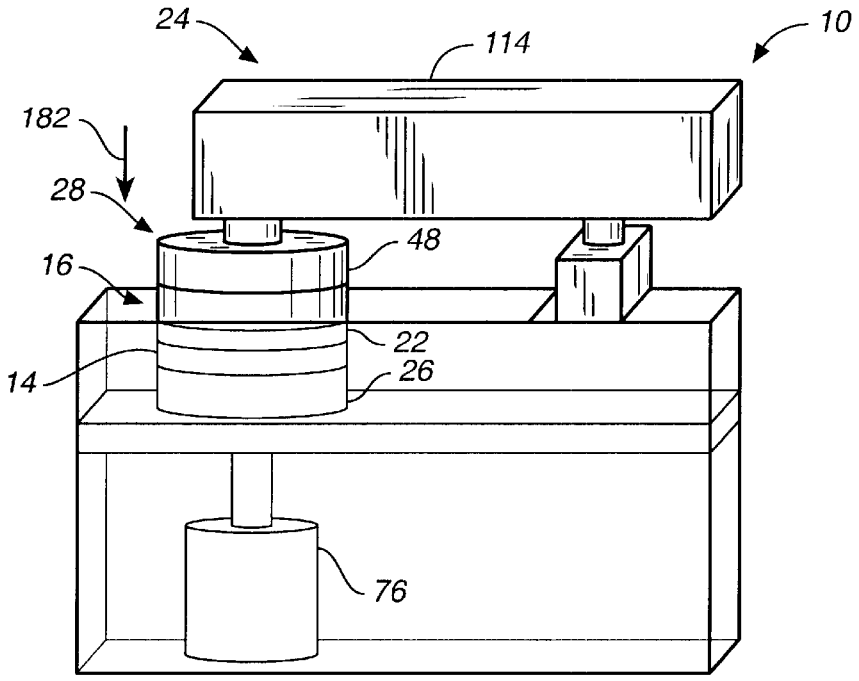
FIG. 3A is a perspective representation of the arrangement of FIG. 1 showing a first polishing pad in contact with a surface of a semiconductor wafer.
Figure 3B:
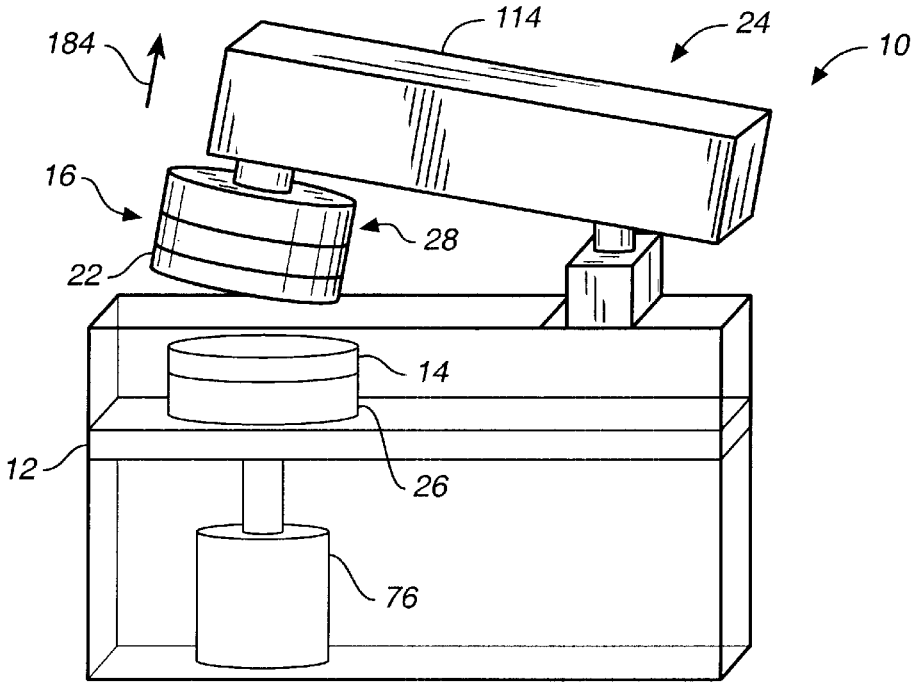
FIG. 3B is a representation similar to FIG. 3A, but showing the polishing pad being moved away from the semiconductor wafer.
Figure 3C:
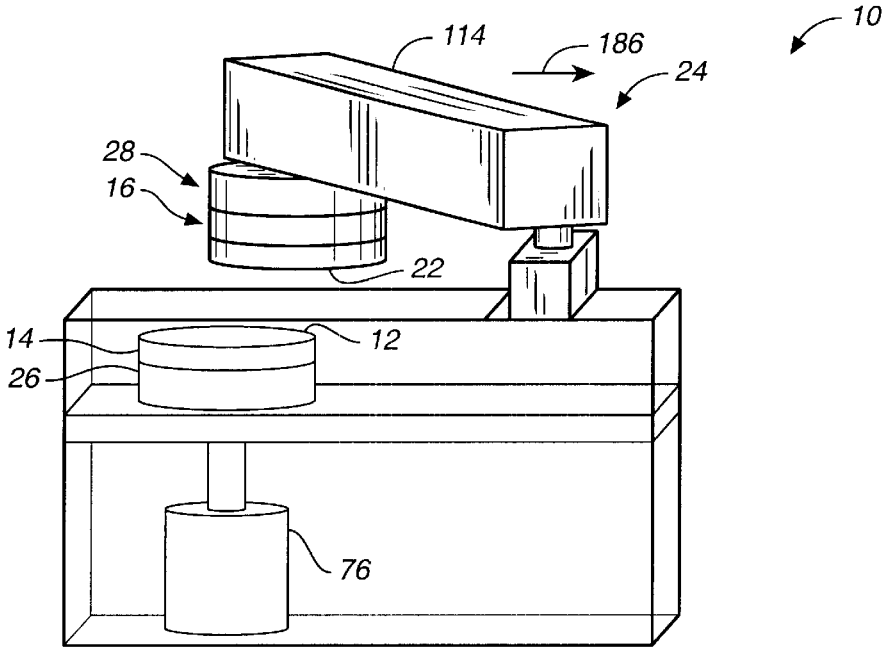
FIG. 3C is a representation similar to FIG. 3B, but showing an actuating mechanism being rotated away from the semiconductor wafer.
Figure 3D:
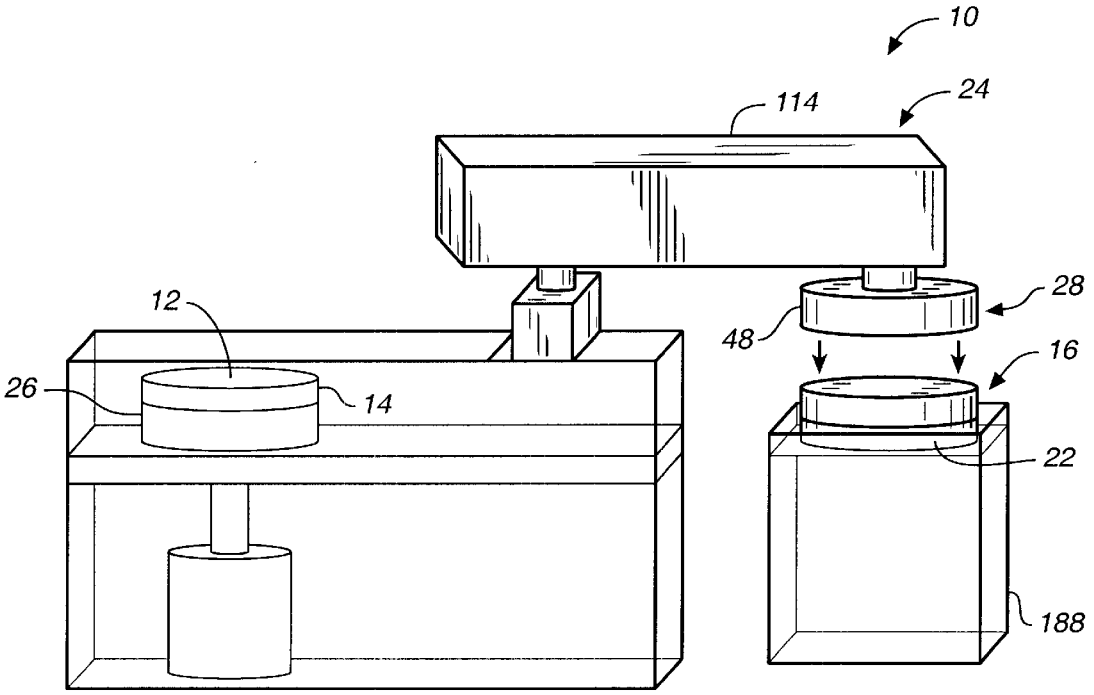
FIG. 3D is a representation similar to FIG. 3C, but showing the actuating mechanism aligned with a receiving stage and the attachment mechanism in the decoupling mode of operation.

Referring now to FIG. 1, there is shown a partial schematic representation of an exemplary arrangement 10 for polishing a surface 12 (see FIG. 3B) of a semiconductor wafer 14 which incorporates the features of the present invention therein. Arrangement 10 includes a frame 74, a motor 76, a drive shaft 78, and a plate 80. Arrangement 10 also includes a wafer carrier 26, a polishing pad assembly 16, a polishing pad assembly 30 (see FIG. 3F), an attachment mechanism 28, a controller 84, and an actuating mechanism 24 which has an arm 114 and a motor 82. Arrangement 10 further includes a receiving stage 188 (see FIG. 3D) and a pickup stage 190 (See FIG. 3E).

Figure 2A:
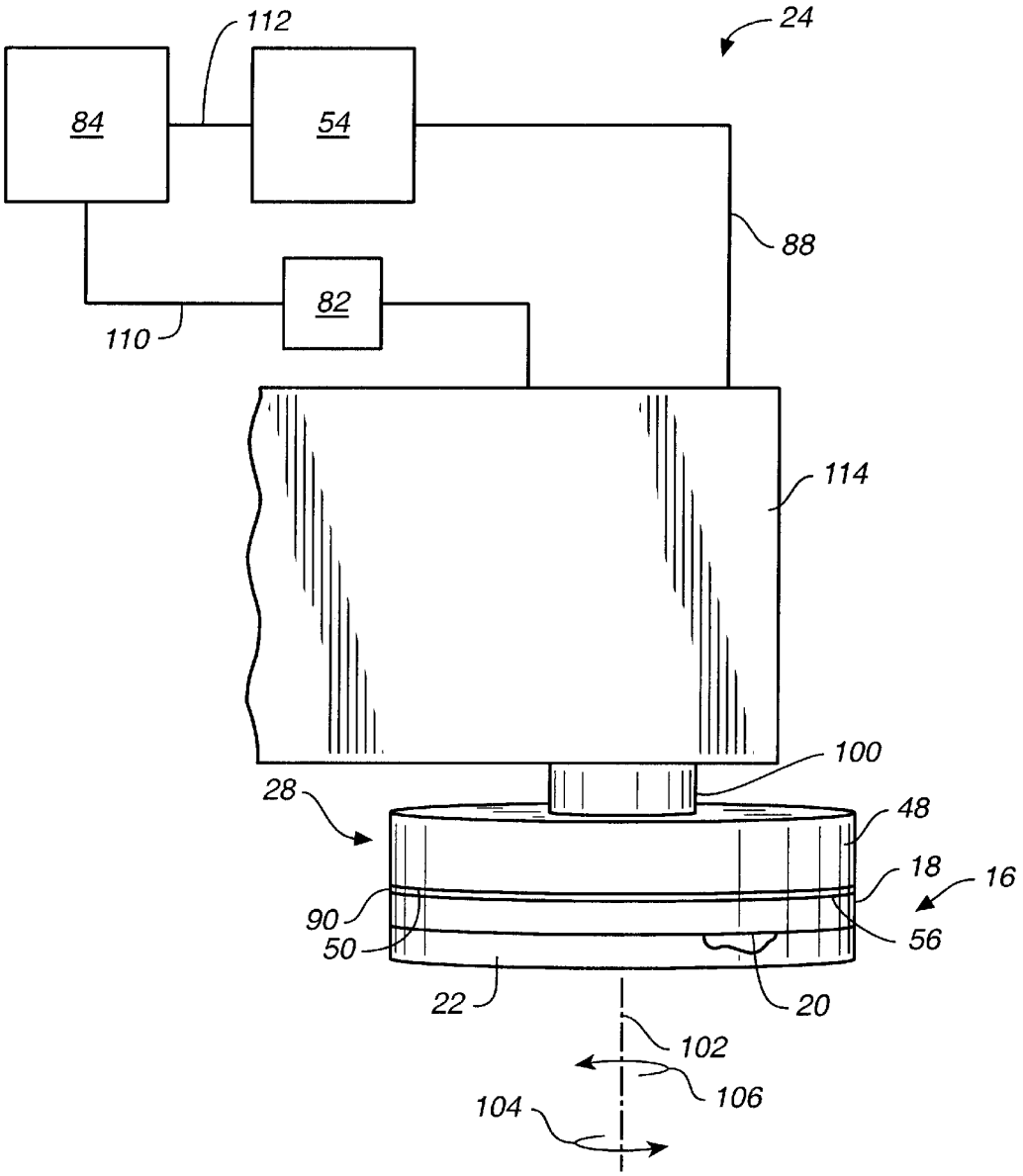
FIG. 2A is a fragmentary partial schematic representation of the arrangement of claim 1 showing an attachment mechanism in a coupling mode of operation.
Figure 2B:
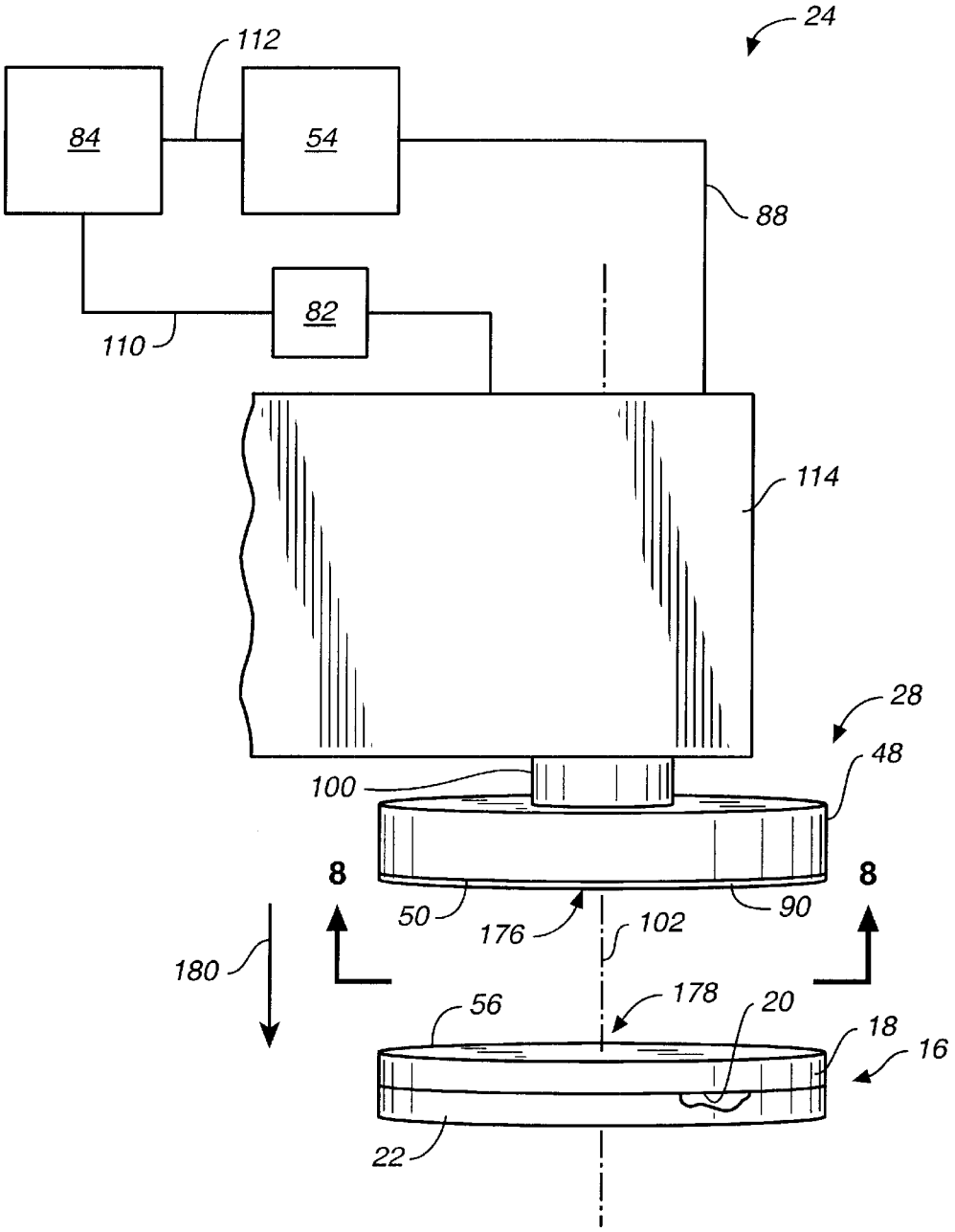
FIG. 2B is a representation similar to FIG. 2A, but showing the attachment mechanism in a decoupling mode of operation.
Figure 8:
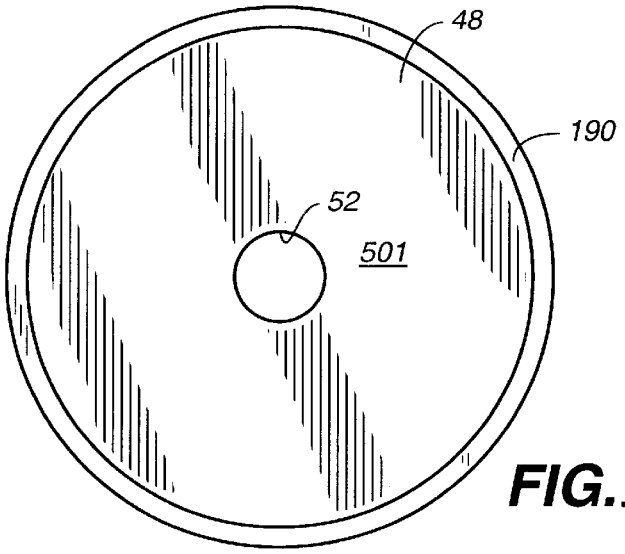
FIG. 8 is a side view of a platen of an attachment mechanism as viewed in the direction of arrows 8—8 of FIG. 2B.

As shown in FIGS. 2A, 2B, and 8 attachment mechanism 28 includes a vacuum pump 54 and a platen 48 having a shaft 100 extending therefrom. Platen 48 has a vacuum surface 50 defined thereon. Vacuum surface 50 has a port 52 defined therein which is in fluid communication with vacuum pump 54 via a hose 88 such that vacuum pump 54 can advance air through port 52. Attachment mechanism 28 also includes a resilient O-ring 90 attached to vacuum surface 50 such that O-ring 90 is substantially concentric with port 52.

Figure 4A:
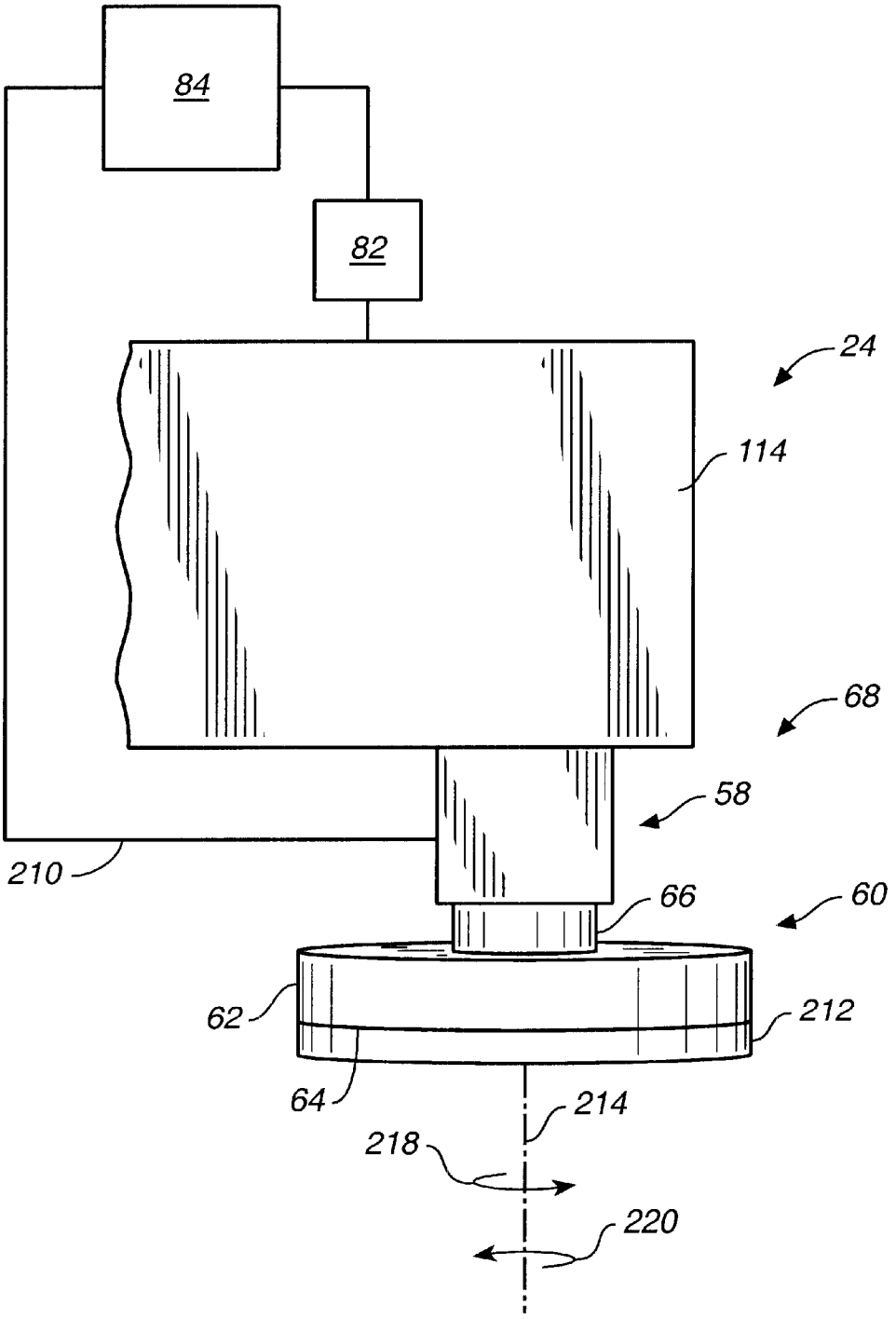
FIG. 4A is a representation similar to FIG. 2A, but showing an alternative embodiment of an attachment mechanism in a coupling mode of operation.
Figure 4B:
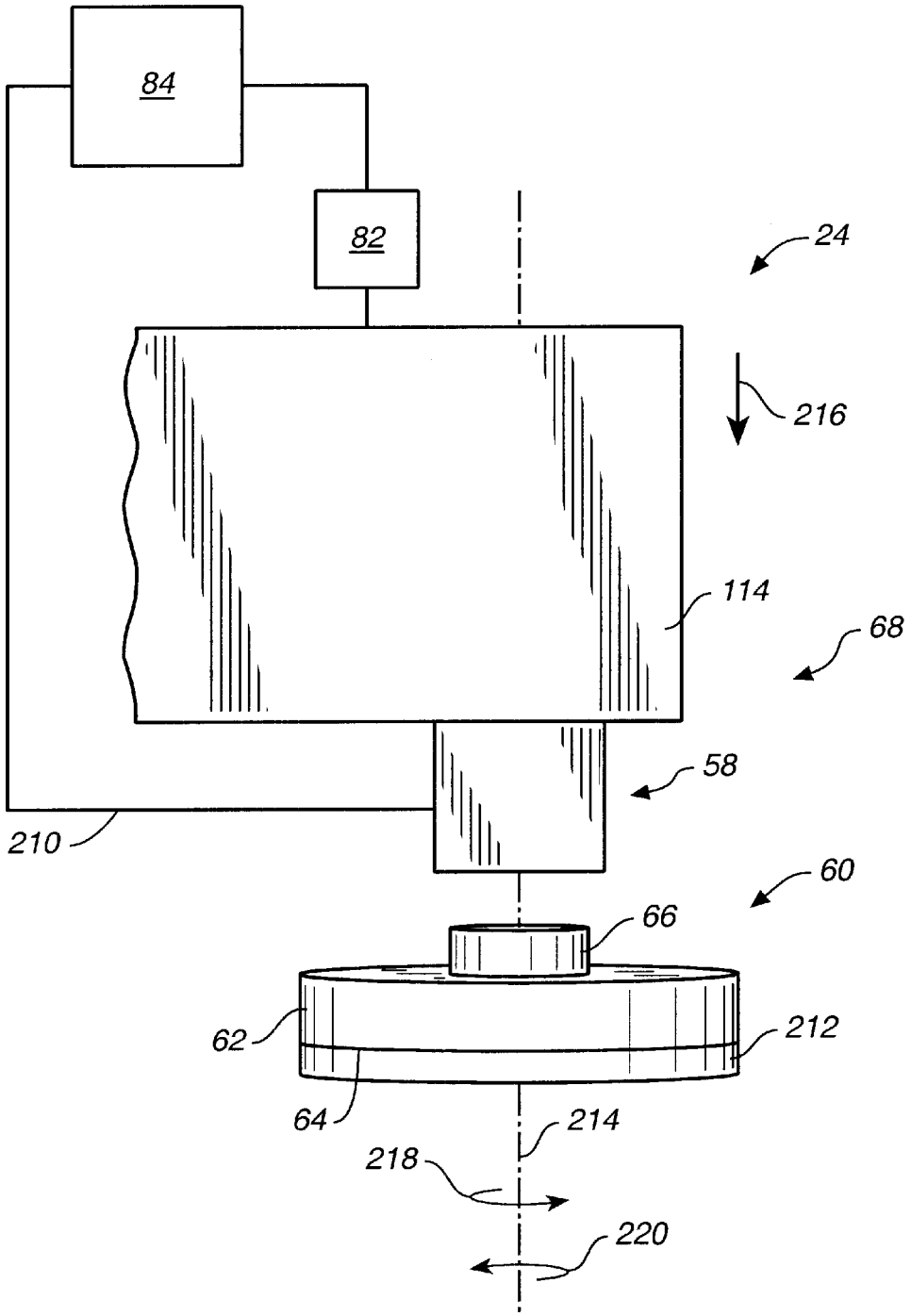
FIG. 4B is a representation similar to FIG. 4A, but showing the attachment mechanism in a decoupling mode of operation.

FIG. 4A and 4B, show an alternative attachment mechanism 68 which can be used in the present invention in place of attachment mechanism 28. Attachment 68 includes a chuck 58 attached to arm 114 and mechanically coupled to motor 82. In addition, chuck 58 is operatively coupled to controller 84 via line 210.

Figure 10:
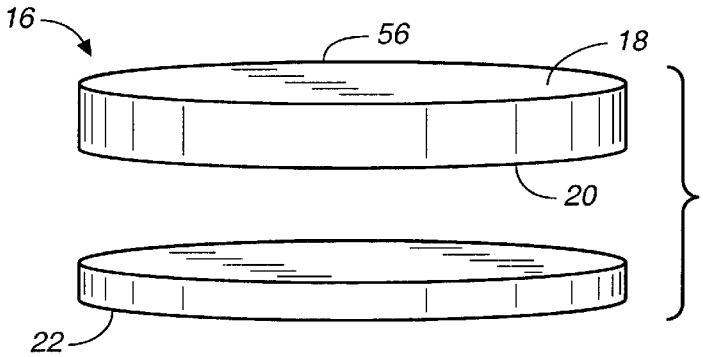
FIG. 10 is a side elevational view of a polishing pad assembly.

Now referring to FIGS. 2A, 2B, and 10, polishing pad assembly 16 includes a support member 18 (e.g. a metal plate) having a pad receiving surface 20 and a platen receiving surface 56 defined thereon. Polishing pad assembly 16 also includes a polishing pad 22 attached to pad receiving surface 20. For example, polishing pad 22 can be attached to pad receiving surface 20 with any well known appropriate commercially available adhesive. Note that a polishing pad having an abrasive particle attached thereto can be utilized for the polishing pad in the present invention.

Figure 3E:
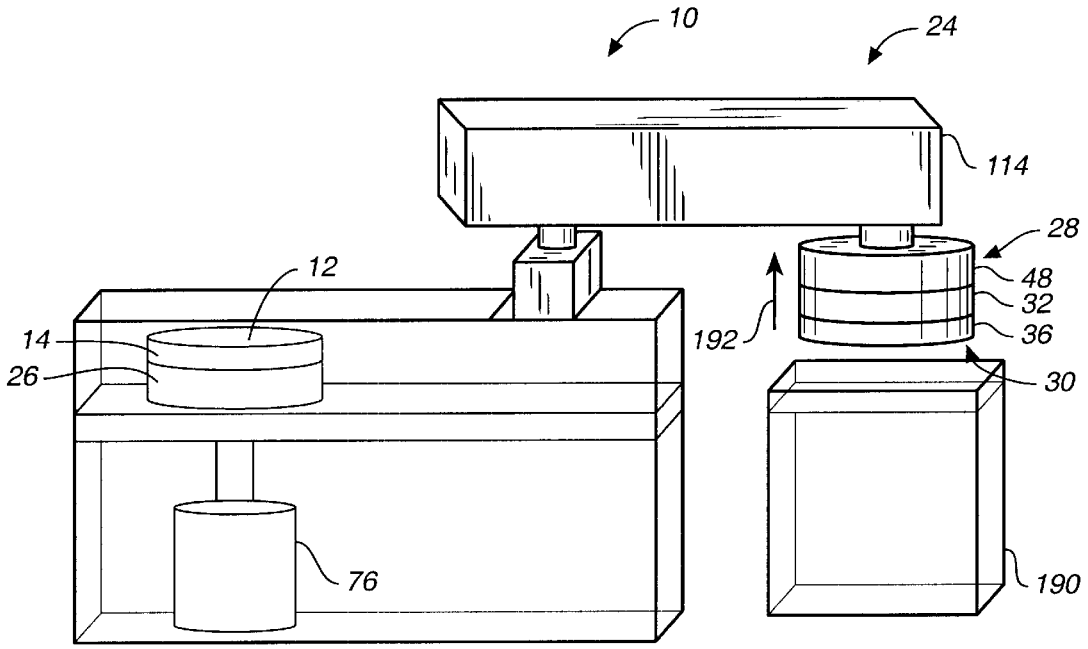
FIG. 3E is a representation similar to FIG. 3D, but showing the actuating mechanism aligned with a pickup stage and the attachment mechanism in the coupling mode of operation.
Figure 3F:
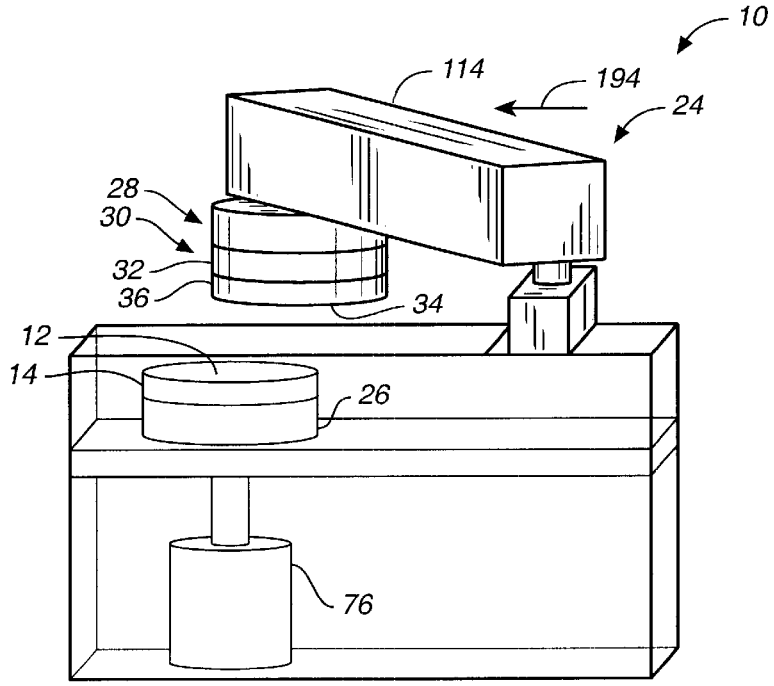
FIG. 3F is a representation similar to FIG. 3E, but showing the actuating mechanism being rotated toward the semiconductor wafer.

As shown in FIG. 3E, polishing pad assembly 30 is structurally substantially identical with polishing pad assembly 16. In particular, polishing pad assembly 30 also includes a support member 32 having a pad receiving surface and a platen receiving surface defined thereon. Polishing pad assembly 30 also includes a polishing pad 36 attached to the pad receiving surface of support member 32. It should be understood that all of the polishing pad assemblies utilized in the present invention are "preassembled", that is the polishing pad is appropriately aligned with and secured to the pad receiving surface of the support member prior to the polishing pad assembly being coupled to an actuating mechanism, such as actuating mechanism 24.

FIGS. 4A and 4B, show an alternative polishing pad assembly 60 which can be utilized with attachment mechanism 68. Polishing pad assembly 60 includes a support member 62 having a shaft 66 attached thereto and extending therefrom. Polishing pad assembly 60 also includes a polishing pad 212 attached to polishing pad receiving surface 64 of support member 62.

Figure 7A:
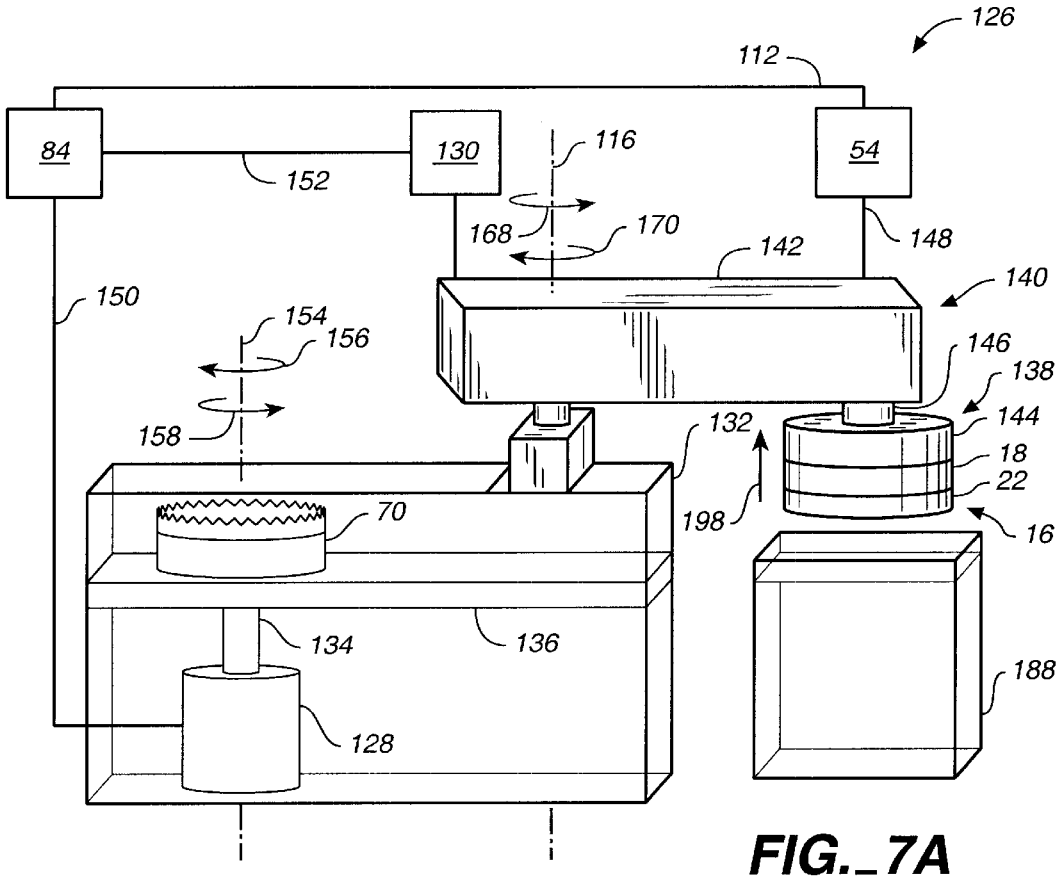
FIG. 7A is an exemplary schematic representation of an arrangement for conditioning a polishing pad which incorporates the features of the present invention therein.
Figure 7B:
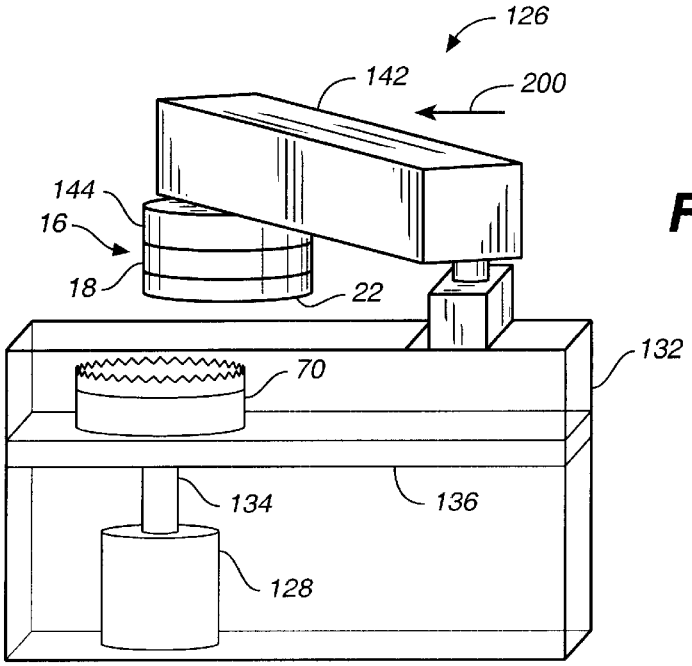
FIG. 7B is a representation similar to FIG. 7A, but showing the polishing pad being moved toward a conditioning tool.

Referring now to FIG. 7A, there is shown a partial schematic representation of an exemplary arrangement 126 for conditioning polishing pads (e.g. polishing pad 22) which incorporates the features of the present invention therein. Arrangement 126 is substantially similar to arrangement 10 with the exception that arrangement 126 includes a conditioning tool 70 mechanically coupled to a motor 128 rather than wafer carrier 26. Arrangement 126 further includes a frame 132, a drive shaft 134, and a plate 136. Arrangement 126 also includes an attachment mechanism 138, and an actuating mechanism 140 which has an arm 142 and a motor 130.

Attachment mechanism 138 is substantially identical to attachment mechanism 28. In particular, attachment mechanism 138 includes a platen 144 having a shaft 146 extending therefrom. Like platen 48, platen 144 also has a vacuum surface (not shown) defined thereon which is substantially identical to vacuum surface 50 (see FIG. 8). The vacuum surface of platen 144 also has a port (not shown) defined therein which is in fluid communication with vacuum pump 54 via a hose 148 such that vacuum pump 54 can advance air through the port. Attachment mechanism 138 also includes a resilient O-ring (not shown) attached to the vacuum surface such that the O-ring is substantially concentric with the port.

Now referring back to FIG. 1, controller 84 is operatively coupled to motor 76 and motor 82 via lines 108 and 110, respectively. Controller 84 is also operatively coupled to vacuum pump 54 via line 112. Plate 80 is secured to frame 74. Motor 76 is positioned relative to plate 80 so that drive shaft 78 of motor 76 extends through plate 80 and is mechanically coupled to wafer carrier 26. Motor 76 is able to rotate wafer carrier 26 around an axis 92 in the directions indicated by arrows 94 and 96. Semiconductor wafer 14 is attached to wafer receiving surface 98 of wafer carrier 26 in a well known manner so that rotation of wafer carrier 26 also causes the rotation of semiconductor wafer 14. Shaft 100 of platen 48 is mechanically coupled to arm 114 of actuating mechanism 24. Motor 82 is mechanically coupled to shaft 100 so that motor 82 can rotate platen 48 around an axis 102 in the directions indicated by arrows 104 and 106. Motor 82 is also mechanically coupled to arm 114 so that motor 82 can rotate arm 114 around an axis 116 in the directions indicated by arrows 1 18 and 120. Motor 82 is further coupled to arm 114 so that motor 82 can pivot arm 114 relative to frame 74 in the directions indicated by arrows 122 and 124.

As shown in FIG. 7A, arrangement 126 is constructed in a substantially similar manner as arrangement 10. In particular, controller 84 is operatively coupled to motor 128 and motor 130 via lines 150 and 152, respectively. (Note that controller 84, vacuum pump 54, and motor 130 are only shown in FIG. 7A for clarity of description.) Plate 136 is secured to frame 132. Motor 128 is positioned relative to plate 136 so that drive shaft 134 extends through plate 136 and is mechanically coupled to conditioning tool 70. Motor 128 can rotate conditioning tool 70 around an axis 154 in the directions indicated by arrows 156 and 158. Shaft 146 of platen 144 is mechanically coupled to arm 142 of actuating mechanism 140. Motor 130 is mechanically coupled to shaft 146 so that motor 130 can rotate platen 144 around an axis 160 in the directions indicated by arrows 162 and 164 (see FIG. 7D). Motor 130 is also mechanically coupled to arm 142 so that motor 130 can rotate arm 142 around an axis 116 in the directions indicated by arrows 168 and 170. Motor 130 is further coupled to arm 142 so that motor 130 can pivot arm 142 relative to frame 132 in the directions indicated by arrows 172 and 174 (see FIG. 7C).

It should be understood that attachment mechanism 28 and attachment mechanism 138 are both selectively operable between (i) a coupling mode of operation and (ii) a decoupling mode of operation. Attachment mechanism 28 and attachment mechanism 138 operate in a substantially identical manner and therefore only attachment mechanism 28 will be discussed in detail herein. As shown in FIG. 2B, to attach polishing pad assembly 16 to platen 48, platen 48 is first positioned relative to polishing pad assembly 16 so that axis 102 is substantially aligned with (i) a center location 176 defined on platen 48 and (ii) a center location 178 defined on support member 18. Once aligned in the above described manner, a signal from controller 84 is sent to motor 82 so that arm 114 is pivoted in the direction indicated by arrow 122 (see FIG. 1) so that platen 48 moves toward support member 18 in the direction indicated by arrow 180 until O-ring 90 is in contact with platen receiving surface 56 as shown in FIG. 2A. Once O-ring 90 is in contact with platen receiving surface 56 controller 84 sends a signal to attachment mechanism 28 so as to place attachment mechanism 28 in the coupling mode of operation. In particular, controller 84 sends a signal to vacuum pump 54 via line 112 thereby causing vacuum pump 54 to advance air through port 52 so as to create a vacuum between vacuum surface 50 and platen receiving surface 56. Once the aforementioned vacuum is created between vacuum surface 50 and platen receiving surface 56, controller 84 sends another signal to vacuum pump 54 so that vacuum pump 54 stops advancing air through port 52. It should be understood that placing attachment mechanism 28 in the coupling mode of operation, and thereby creating the aforementioned vacuum, keeps polishing pad assembly 16 (i) attached to platen 48 and (ii) coupled to actuating mechanism 24. Therefore, when platen 48 is rotated around axis 102 in the directions indicated by arrows 104 and 106, polishing pad assembly 16 is also rotated in the directions indicated by arrows 104 and 106.

To detach polishing pad assembly 16 from platen 48 controller 84 sends a signal to attachment mechanism 28 so as to place attachment mechanism 28 in the decoupling mode of operation. In particular, controller 84 sends a signal to vacuum pump 54 so that air is allowed to advance through port 52 and in between vacuum surface 50 and platen receiving surface 56. For example, controller 84 can send a signal to vacuum pump 54 so that a valve (not shown) opens and allows air to rush in between vacuum surface 50 and platen receiving surface 56. Allowing air to be advanced in between vacuum surface 50 and platen receiving surface 56 breaks the vacuum therebetween and thus causes polishing pad assembly 16 to detach from platen 48. Thus, in light of the above discussion it should be understood that placing attachment mechanism 28 in the decoupling mode operation, and thereby breaking the aforementioned vacuum, results in polishing pad assembly 16 being (i) detached from platen 48 and (ii) decoupled from actuating mechanism 24 as shown in FIG. 2B.

Attachment mechanism 68 is also selectively operable between (i) a coupling mode of operation and (ii) a decoupling mode of operation. As shown in FIG. 4B, to attach polishing pad assembly 60 to chuck 58, chuck 58 is first positioned relative to polishing pad assembly 60 so that chuck 58 is substantially aligned with shaft 66. Once aligned in the above described manner, a signal from controller 84 is sent to motor 82 so that arm 114 is pivoted in the direction indicated by arrow 216 so that shaft 66 is inserted into chuck 58 as shown in FIG. 4A. Once shaft 66 is located in chuck 58 controller 84 sends a signal to attachment mechanism 68 so as to place attachment mechanism 68 in the coupling mode of operation. In particular, controller 84 sends a signal to chuck 58 via line 210 thereby causing chuck 58 to engage and hold shaft 66 thereby attaching polishing pad assembly 60 to chuck 58. It should be understood that placing attachment mechanism 68 in the coupling mode operation keeps polishing pad assembly 60 (i) attached to chuck 58 and (ii) coupled to actuating mechanism 24. Therefore, when chuck 58 is rotated around an axis 214 in the directions indicated by arrows 218 and 220, polishing pad assembly 60 is also rotated in the directions indicated by arrows 218 and 220.

To detach polishing pad assembly 60 from chuck 58, controller 84 sends a signal to attachment mechanism 68 so as to place attachment mechanism 68 in the decoupling mode of operation. In particular, controller 84 sends a signal to chuck 58 so that chuck 58 releases shaft 66. Having chuck 58 release shaft 66 causes polishing pad assembly 60 to detach from chuck 58. Thus, in light of the above discussion it should be understood that placing attachment mechanism 68 in the decoupling mode operation results in polishing pad assembly 60 being (i) detached from chuck 58 and (ii) decoupled from actuating mechanism 24 as shown in FIG. 4B.

FIGS. 3A–3H, shows arrangement 10 being utilized to manufacture semiconductor 14. Note that controller 84, motor 82, and vacuum 54 are not shown in FIGS. 3A–3H for clarity of description. Each of FIGS. 3A–3H is discussed in detail below. In particular, FIG. 3A shows attachment mechanism 28 in the coupling mode of operation, thus polishing pad assembly 16 is attached to platen 48 and coupled to actuating mechanism 24. Moreover, FIG. 3A shows arrangement 10 after controller 84 has sent a signal to motor 82 via line 110 such that motor 82 positions arm 114 relative to wafer carrier 26 so that polishing pad 22 is in contact with surface 12 of semiconductor wafer 14. Note that when attachment mechanism 28 is in the coupling mode of operation and polishing pad 22 is in contact with semiconductor wafer 14, polishing pad assembly 16 is located vertically above wafer carrier 26. Once polishing pad 22 is in contact with surface 12, controller 84 sends (i) a signal to motor 76 via line 108 so that motor 76 rotates wafer carrier 26, and thus semiconductor wafer 14, around axis 92 (see FIG. 1) in one direction and (ii) a signal to motor 82 via line 110 so that motor 82 rotates platen, and thus polishing pad 22, around axis 102 (see FIG. 1) in another direction which is opposite to the direction wafer carrier 26 is being rotated. It should be appreciated that controller 84 also sends a signal to motor 82 such that motor 82 urges arm 114 toward wafer carrier 26 in the direction indicated by arrow 182. Urging arm 114 in the above described manner ensures polishing pad 22 is urged against surface 12 of semiconductor wafer 12 with an appropriate force.

As shown in FIG. 3B, after contacting surface 12 of semiconductor wafer 14 with polishing pad 22 in the above described manner so that surface 12 is polished to an appropriate end point, controller 84 sends a signal to motor 82 such that motor 82 moves arm 114, and thus polishing pad assembly 16, in the direction indicated by arrow 184. Moving arm 114 in the direction indicated by arrow 184 removes polishing pad 22 from surface 12 whereupon controller 84 sends a signal to motor 76 so as to cause motor 76 to stop rotating wafer carrier 26 and semiconductor wafer 14. Once wafer carrier 26 stops rotating, semiconductor wafer 14 is removed from wafer carrier 26 and another semiconductor wafer (not shown) is attached to wafer carrier 26. The semiconductor wafer replacing semiconductor wafer 14 is then polished by once again positioning arm 114 relative to wafer carrier 26 so that polishing pad 22 is in contact with a surface of the semiconductor wafer and then repeating the above described polishing steps.

It should be appreciated that a plurality of semiconductor wafers can be polished with polishing pad 22 by repeating the above described procedure with a number of semiconductor wafers. However, it should also be appreciated that after polishing a number of semiconductor wafers with polishing pad 22 (e.g. five), or utilizing polishing pad 22 for a certain period of time, polishing pad 22 needs to be subjected to a process known as "conditioning". Generally, the term "conditioning" as used in reference to a polishing pad refers to the steps taken to counter the smoothing or glazing of a surface of the polishing pad and to achieve a relatively high and stable polishing rate. As such, conditioning is herein defined as a technique used to maintain a surface of a polishing pad in a state which enables proper polishing of a surface of a semiconductor wafer. Conditioning is typically performed by mechanically abrading a surface of a polishing pad with a conditioning tool in order to renew that surface. Such mechanical abrasion of a polishing pad may roughen the surface thereof and remove particles which are embedded in the pores of the polishing pad. Removing these particles enhances the polishing pad's ability to polish.

For example, if during the polishing of semiconductor wafer 14 controller 84 determines that the time period for conditioning polishing pad 22 has past, then controller 84 sends a signal to motor 82 so that polishing pad 22 is removed from surface 12 of semiconductor 14 as shown in FIG. 3B. Controller 84 then sends a signal to motor 82 so that motor 82 moves arm 114 in the direction indicated by arrow 186 as shown in FIG. 3C. As shown in FIG. 3D, motor 82 continues to move arm 114 in the direction indicated by arrow 186 until platen 48 of attachment mechanism 28 is aligned with receiving stage 188. Once platen 48 is aligned with receiving stage 188, controller 84 sends a signal to attachment mechanism 28 so as to place attachment mechanism 28 in the decoupling mode of operation as described above. Placing attachment mechanism 28 in the decoupling mode of operation allows polishing pad assembly 16 to be detached from platen 48 and be positioned on receiving stage 188.

As shown in FIG. 3E, after placing polishing pad assembly 16 on receiving stage 188, controller 84 sends a signal to motor 82 so that motor 82 moves arm 114 so as to align platen 48 with polishing pad assembly 30 resting on pickup stage 190. Note that platen 48 is aligned relative to polishing pad assembly 30 in a substantially,identical manner as that discussed above in reference to FIG. 2B. In addition, once aligned, polishing pad assembly 30 is attached to platen 48 in a substantially identical manner as described above in reference to polishing pad assembly 16. In particular, a signal from controller 84 is sent to motor 82 so that platen 48 moves toward support member 32 until O-ring 90 (see FIG. 8) is in contact therewith. Once O-ring 90 is in contact with the platen receiving surface of support member 32 controller 84 sends a signal to attachment mechanism 28 so as to place attachment mechanism 28 in the coupling mode of operation. In particular, as previously discussed, controller 84 sends a signal to vacuum pump 54 thereby causing vacuum pump 54 to advance air through port 52 so as to create a vacuum between vacuum surface 50 (see FIG. 8) and the platen receiving surface defined on support member 32. Once a the aforementioned vacuum is created between vacuum surface 50 and the platen receiving surface of support member 32, controller 84 sends another signal to vacuum pump 54 so that vacuum pump 54 stops advancing air through port 52. As with polishing pad assembly 16, placing attachment mechanism 28 in the coupling mode operation, and thereby creating the aforementioned vacuum, keeps polishing pad assembly 30 (i) attached to platen 48 and (ii) coupled to actuating mechanism 24. Therefore, when platen 48 is rotated around axis 102 in the directions indicated by arrows 104 and 106, polishing pad assembly 30 is also rotated in the directions indicated by arrows 104 and 106.

Figure 3G:
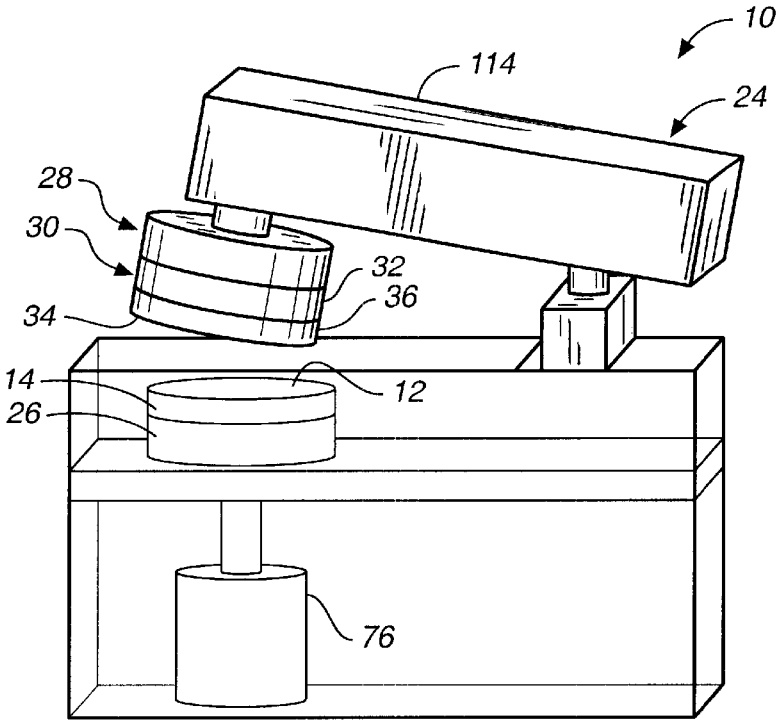
FIG. 3G is a representation similar to 3F, but showing the actuating mechanism and a second polishing pad aligned with the semiconductor wafer.
Figure 3H:
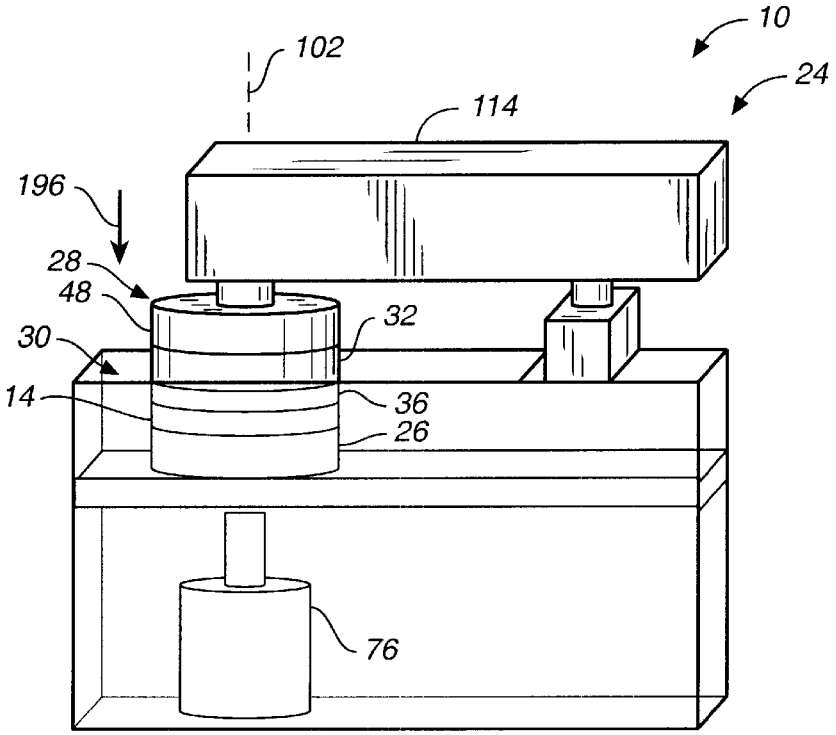
FIG. 3H is a representation similar to FIG. 3G, but showing the second polishing pad in contact with the surface of the semiconductor wafer.

As shown in FIG. 3E, once polishing pad assembly 30 is attached to platen 48 controller 84 sends a signal to motor 82 so that motor 82 moves arm 114 in the direction indicated by arrow 192 thereby removing polishing pad assembly 30 from pickup stage 190. Controller 84 then sends a signal to motor 82 so that motor 82 moves arm 114 in the direction indicated arrow 194 (see FIG. 3F) until polishing pad assembly 30 is aligned with wafer carrier 26 and semiconductor wafer 14 as shown in FIG. 3G. Once polishing pad assembly 30 is aligned with semiconductor wafer 14, controller 84 sends a signal to motor 82 so that motor 82 moves arm 114 in the direction indicated by arrow 196 until polishing pad 36 is placed in contact with semiconductor wafer 14 as shown in FIG. 3H. Controller 84 then sends a signal to motor 82 such that motor 82 rotates platen 48 and polishing pad assembly 30 around axis 102 in a direction which is opposite to the direction wafer carrier 26 and semiconductor wafer 14 are being rotated by motor 76. As such, the polishing of surface 12 of semiconductor wafer 14 can continue. It should be appreciated that a plurality of semiconductor wafers can now be polished with polishing pad assembly 30 in the same manner as described above for polishing pad assembly 16.

As shown in FIGS. 7A–7F, arrangement 126 cooperates with arrangement 10 to condition polishing pads. For example, after polishing pad assembly 16 is placed on receiving stage 188 as described above, arrangement 126 functions to condition polishing pad 22 so that polishing pad 22 can be utilized again to polish a number of semiconductor wafers. In particular, as shown in FIG. 7A, once polishing pad assembly 16 is placed on receiving stage 188, controller 84 sends a signal to motor 130, via line 152, so that motor 130 moves arm 142 so as to align platen 144 with polishing pad assembly 16 resting on receiving stage 188. Note that platen 144 is aligned relative to polishing pad assembly 16 in a substantially identical manner as that discussed above in reference to FIG. 2B. Once aligned, a signal from controller 84 is sent to motor 130 so that arm 142 and platen 144 moves toward support member 18 until an O-ring (not shown) attached to a vacuum surface (not shown) defined on platen 144 contacts support member 18. Once the O-ring is in contact with the platen receiving surface of support member 18 controller 84 sends a signal to attachment mechanism 138 so as to place attachment mechanism 138 in the coupling mode of operation thereby (i) attaching polishing pad assembly 16 to platen 144 and (ii) coupling polishing pad assembly to actuating mechanism 140 in a manner substantially identical to that described above in reference to attachment mechanism 28.

Figure 7C:
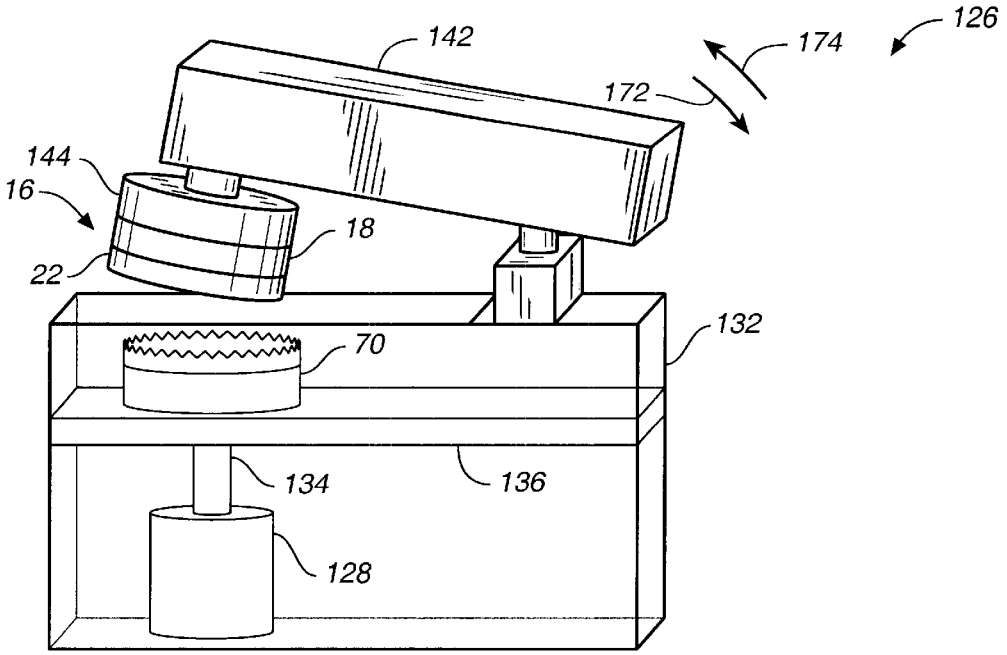
FIG. 7C is a representation similar to FIG. 7B, but showing the polishing pad being aligned the conditioning tool.
Figure 7D:
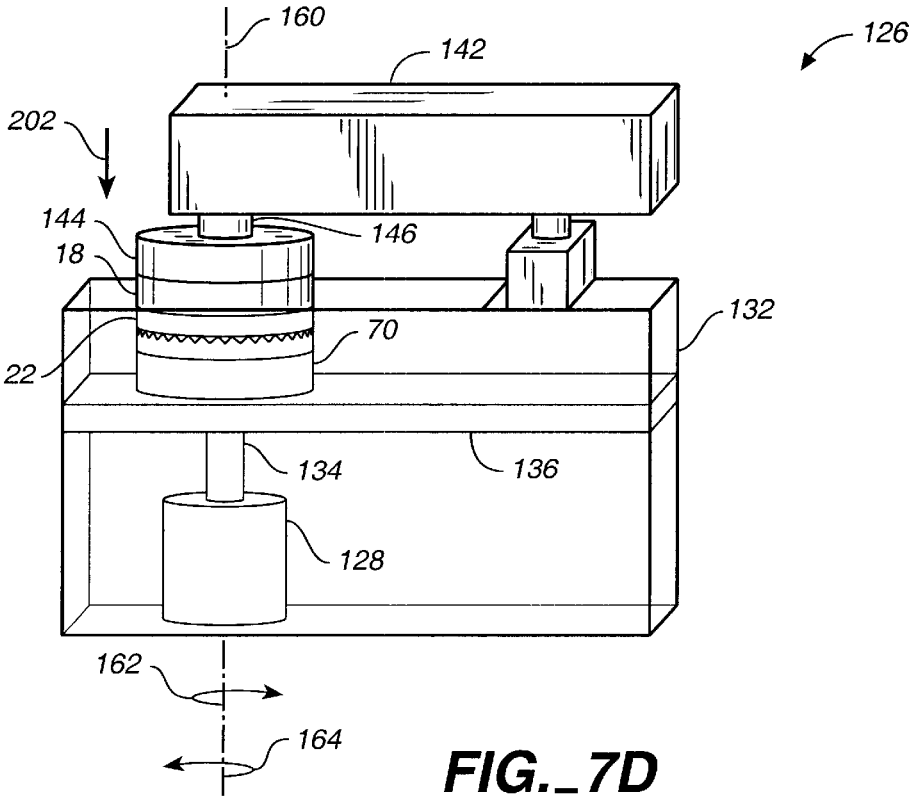
FIG. 7D is a representation similar to FIG. 7C, but showing the polishing pad placed in contact with the conditioning tool.

As shown in FIG. 7A, once polishing pad assembly 16 is attached to platen 144 controller 84 sends a signal to motor 130 so that motor 130 moves arm 142 in the direction indicated by arrow 198 thereby removing polishing pad assembly 16 from receiving stage 188. Controller 84 then sends a signal to motor 130 so that motor 130 moves arm 142 in the direction indicated arrow 200 (see FIG. 7B) until polishing pad assembly 16 is aligned with conditioning tool 70 as shown in FIG. 7C. Once polishing pad assembly 16 is aligned with conditioning tool 70, controller 84 sends a signal to motor 130 so that motor 130 moves arm 142 in the direction indicated by arrow 202 until polishing pad 22 is placed in contact with conditioning tool 70 as shown in FIG. 7D. Controller 84 then sends a signal to motor 130 such that motor 130 rotates platen 144 and polishing pad assembly 16 around axis 160. Controller 84 also sends a signal to motor 128 via line 150 (see FIG. 7A) so that conditioning tool 70 rotates around axis 160 in a direction which is opposite to the direction platen 144 is rotating. Note that conditioning tool 70 can also be held stationary relative to platen 144 while polishing pad 22 is rotated against conditioning tool 70.

Figure 7E:
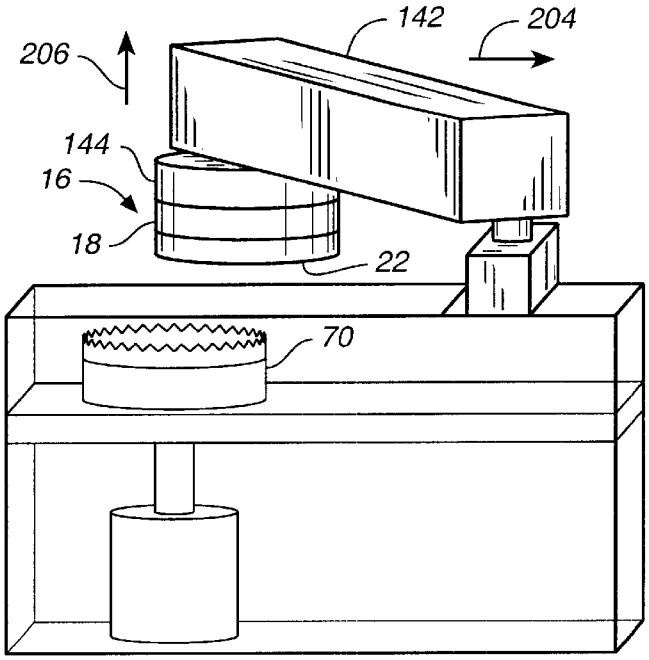
FIG. 7E is a representation similar to FIG. 7D, but showing the polishing pad being moved away from the conditioning tool.
Figure 7F:
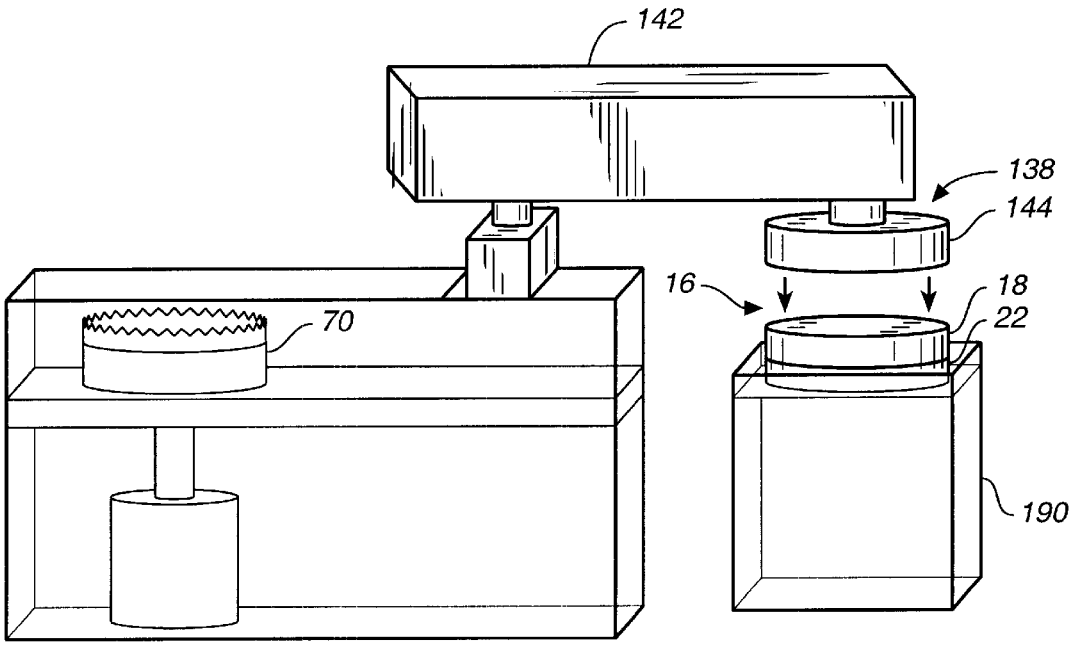
FIG. 7F is a representation similar to FIG. 7E, but showing the polishing pad being placed on the pickup stage.

As shown in FIG. 7E, after contacting polishing pad 22 with conditioning tool 70 for a predetermined amount of time controller 84 sends a signal to motor 130 so that motor 130 moves arm 142 in the directions indicated by arrows 206 and 204 thereby removing polishing pad assembly 22 from conditioning tool 70. As shown in FIG. 7F, motor 130 continues to move arm 142 in the direction indicated by arrow 204 until platen 144 of attachment mechanism 138 is aligned with pickup stage 190. Once platen 144 is aligned with pickup stage 190, controller 84 sends a signal to attachment mechanism 138 so as to place attachment mechanism 138 in the decoupling mode of operation as previously described. Placing attachment mechanism 138 in the decoupling mode of operation allows polishing pad assembly 16 to be detached from platen 144 and be positioned on receiving stage 190.

It should be understood that after completing the conditioning of polishing pad 22 and then placing polishing pad assembly 16 on pickup stage 190 in the above described manner, polishing pad assembly 16 is reused by arrangement 10 to polish another plurality of semiconductor wafers. In particular, once polishing pad 36 of polishing pad assembly 30 requires conditioning and is therefore disposed on receiving stage 188 in a manner substantially identical to that described above in reference to polishing pad assembly 16, polishing pad assembly 16 is removed from receiving stage 190 by attachment mechanism 28 of arrangement 10 in a manner substantially identical to that described above in reference to polishing pad assembly 30. Therefore, polishing pad assembly 16 is utilized to continue to polish a plurality of semiconductor wafers while polishing pad 36 of polishing pad assembly 30 is conditioned by conditioning tool 70 in a manner substantially identical to that described above in reference to polishing pad assembly 16.

Figure 9:
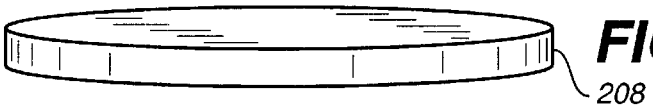
FIG. 9 is a side elevational view of a replacement polishing pad.
Figure 11:
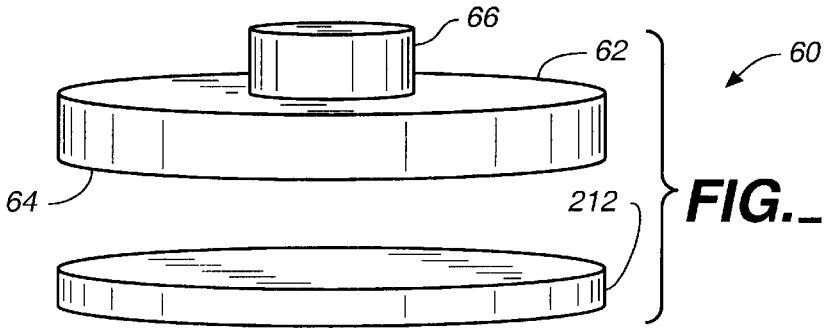
FIG. 11 is a side elevational view of another polishing pad assembly.

It should also be appreciated that after a polishing pad assembly is cycled through arrangements 10 and 126 several times the polishing pad attached to the support member will eventually wear out and have to be replaced. For example, a polishing pad may be used to polish a predetermined number of semiconductor wafers, or used for a certain period of time as tracked by controller 84, before being replaced with a new polishing pad. Once it is determined that a polishing pad of a polishing pad assembly is worn out, that polishing pad assembly can be removed from the system by, for example, removing it from receiving stage 188 and replacing it with another polishing pad assembly having a new or conditioned polishing pad attached to the support member. For example, as shown in FIGS. 9 and 10, once it is determined that polishing pad 22 is worn out, polishing pad 22 is removed from pad receiving surface 20 of support member 18. Polishing pad assembly 16 is then reassembled by attaching a new or conditioned polishing pad 208 to pad receiving surface 20 of support member 18. It should be appreciate that the reassembling of polishing pad assembly 16 can take place while other polishing pad assemblies are being utilized to polish semiconductor wafers, then at the appropriate time (e.g. when arrangement 10 is briefly shut down due to the other polishing pads being worn out) polishing pad assembly 16 is quickly reintroduced into the system, for example placed onto pickup stage 190, so that reassembled polishing pad assembly 16 can attach to attachment mechanism 28 and be utilized to polish a plurality of semiconductor wafers. As shown in FIGS. 9 and 11, once it is determined that polishing pad 212 is worn out, polishing pad 212 is removed from pad receiving surface 64 of support member 62. Polishing pad assembly 60 could also be reassembled by attaching polishing pad 208 to pad receiving surface 64 of support member 62

Moreover, it should be appreciated that, for clarity of description, only two polishing pad assemblies (i.e. polishing pad assemblies 16 and 30) are discussed above as being cycled through arrangements 10 and 126. However, more than two preassembled polishing pad assemblies can be utilized and cycled through arrangements 10 and 126 in the above described manner as long as receiving stage 188 and pickup stage 190 are configured to have two or more polishing pad assemblies disposed thereon. Furthermore, it is contemplated that receiving stage 188 and pickup stage 190 can be configured as polishing pad assembly cassettes each of which can hold a plurality of preassembled polishing pad assemblies for use in arrangements 10 and 126. In addition, it is contemplated that all of the polishing pad assemblies being utilized in the present invention at any one time can be replaced with preassembled polishing pad assemblies during a brief shut down time period of arrangements 10 and 126.

Figure 5A:
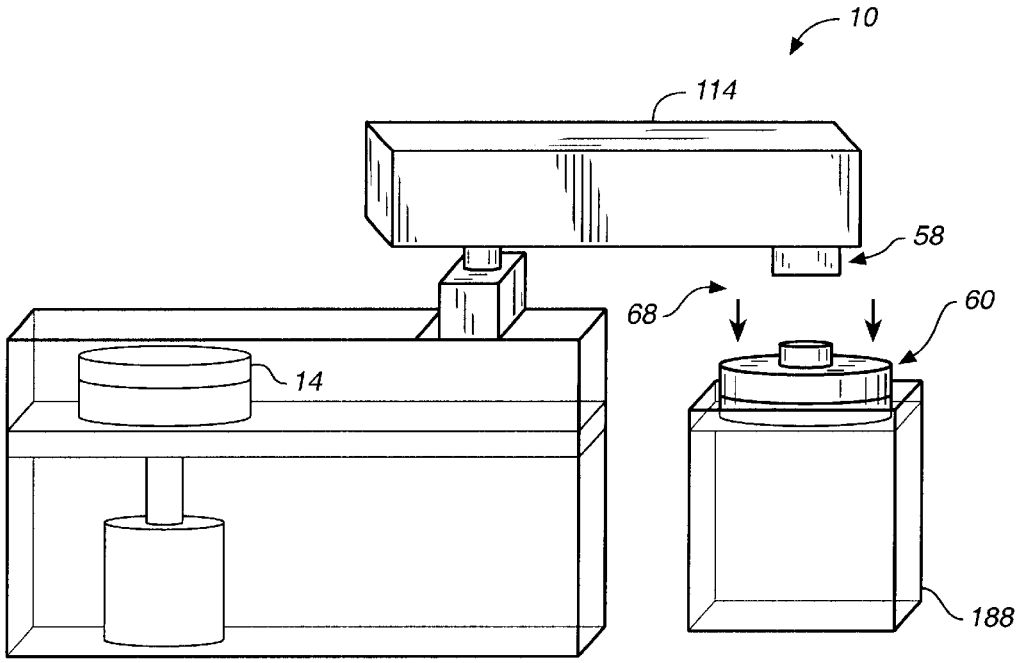
FIG. 5A is a representation similar to 3D, but showing the alternative embodiment of the attachment mechanism in the decoupling mode of operation.
Figure 5B:
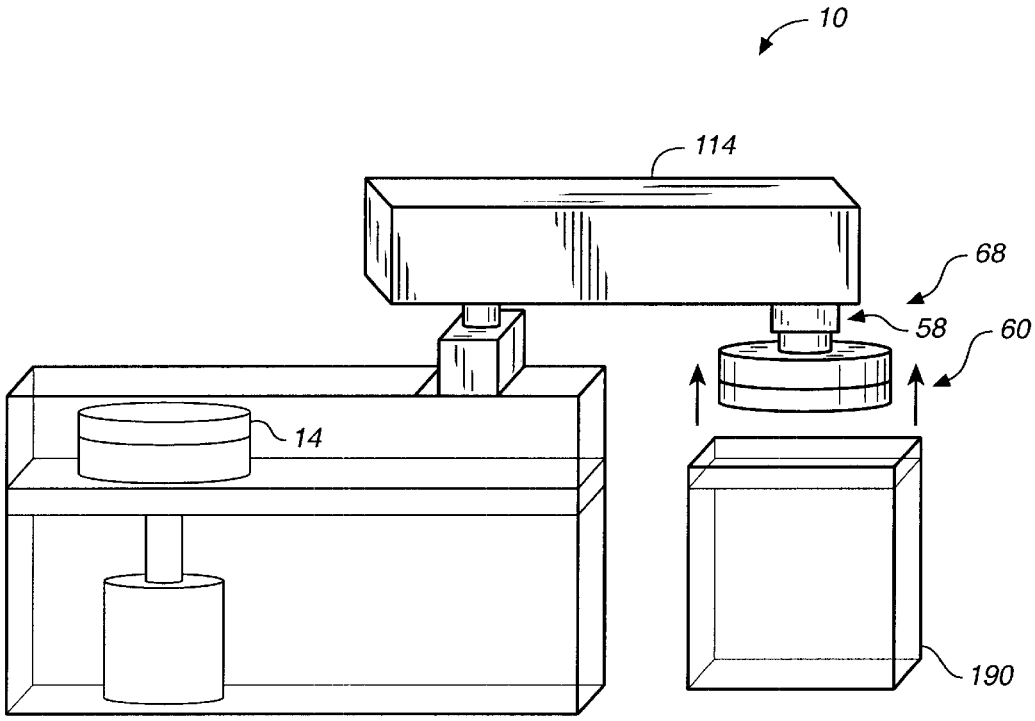
FIG. 5B is a representation similar to 3E, but showing the alternative embodiment of the attachment mechanism in the coupling mode of operation.

Although arrangement 10 is described above as utilizing attachment mechanism 28 as opposed to attachment mechanism 68, it should be understood that arrangement 10 works in a substantially identical manner regardless of which attachment mechanism is utilized. The only difference being the specific details of how attachment mechanism 28 and attachment mechanism 68 attach to, and detach from, the polishing pad assembly. The details of how these attachment mechanisms differ are described above in reference to FIGS. 2A, 2B, 4A, and 4B. FIGS. 5A and 5B show arrangement 10 equipped with attachment mechanism 68 rather than attachment mechanism 28 and further shown how attachment mechanism 68 functions when utilized with arrangement 10. In particular, FIG. 5A shows attachment mechanism 68 in the decoupling mode of operation so that polishing pad assembly 60 is placed on receiving stage 188, while FIG. 5B shows attachment mechanism 68 in the coupling mode of operation so that polishing pad assembly 60 is removed from pickup stage 190. Note that attachment mechanism 68 can also be utilized with arrangement 126.

Figure 6:
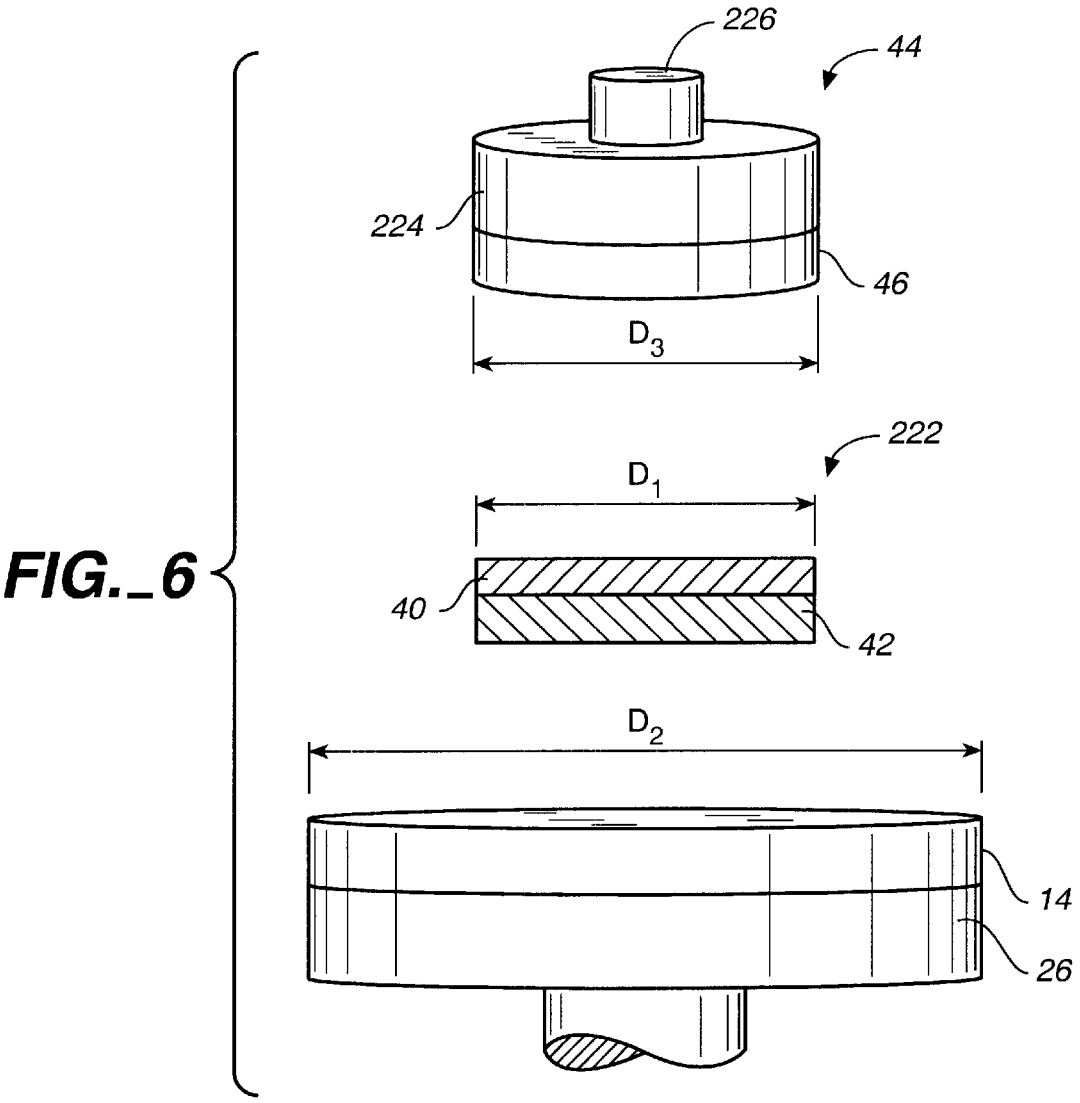
FIG. 6 is a side fragmentary view of the semiconductor wafer supported by a wafer carrier and two alternative embodiments of polishing pad assemblies.

As shown in FIG. 6, arrangement 10 can also utilized polishing pad assemblies 44 or 222. Polishing pad assembly 222 is substantially similar to polishing pad assembly 16. In particular, polishing pad assembly 222 includes a support member 40 having a polishing pad 42 attached thereto. However, polishing pad 42 has a diameter $D_1$ which is smaller than the diameter $D_2$ of semiconductor 14. It should be understood that when polishing pad assembly 22 is utilized, the diameter of platen 48, and thus vacuum surface 50 should be adjusted to be substantially equal to diameter $D_1$. With respect to polishing pad assembly 44, it is substantially similar to polishing pad assembly 60. In particular, polishing pad assembly 44 includes a support member 224 having a shaft 226 attached thereto and extending therefrom. Polishing pad assembly 44 also includes a polishing pad 46 attached to support member 224. However, polishing pad 44 has a diameter $D_3$ which is smaller than the diameter $D_2$ of semiconductor 14. The smaller size of polishing pad assemblies 44 and 222 faciltates the use of a plurality of polishing pad assemblies with arrangements 10 and 126 as discussed above. In particular, the smaller size of polishing pad assemblies 44 and 222 makes it easier to store a plurality of such polishing pad assemblies on a receiving stage or a pickup stage or in a cassette while awaiting to be used. Furthermore, the smaller size of polishing pad assemblies 44 and 222 facilitates the rotary, orbital, or planetary motion of the polishing pad relative to the semiconductor wafer.

In light of the above discussion it should be understood that having a plurality of preassembled polishing pad assemblies available for cycling through arrangements 10 and 126 allows arrangement 10 to continuously polish a multiplicity of semiconductor wafers with relatively little interruption. For example, having a plurality of preassembled polishing pad assemblies utilized in the above described manner allows the conditioning of polishing pads to occur simultaneously with the polishing process, and then allows the conditioned polishing pads to be quickly reused by arrangement 10 to polish additional semiconductor wafers. Furthermore, arrangement 10 allows polishing pad assemblies which have old worn polishing pads attached thereto to be quickly and efficiently replaced with polishing pad assemblies having new or conditioned polishing pads attached thereto with relatively little downtime for arrangement 10. This advantage is a result of the polishing pads being a part of a preassembled polishing pad assembly which can be easily and quickly detached from the attachment mechanism and then conveniently replaced with a substitute preassembled polishing pad assembly. This is in contrast to other semiconductor wafer polishing arrangements which directly attach a polishing pad to a platen which is permanently attached or coupled to the actuating mechanism. In these types of arrangements the polishing pad is typically attached to the platen with an adhesive and therefore must be stripped off of the platen before being replaced with a substitute polishing pad. Once the old polishing pad is removed, the substitute pad has to be realigned on the platen and then reattached thereto with an adhesive before the arrangement can continue to polish semiconductor wafers. This process takes a considerable amount of time and thus requires the polishing process to stop for a significant period of time. This downtime decreases the efficiency of the polishing arrangement, and thus increases the cost of manufacturing semiconductor wafers.

However, the fact all of the polishing pad assemblies of the present invention are preassembled means that the polishing pad has already been appropriately aligned with, and secured to, the support member, and thus the polishing process does not have to be stopped while these steps are being performed. In fact, with the present invention the polishing process only has to be stopped long enough to couple a polishing pad assembly to the actuating mechanism. Since the cooperation between the polishing pad assemblies and the attachment mechanism of present invention allows a polishing pad assembly to be quickly coupled to the actuating mechanism the polishing process does not have to be stopped for an extended period of time. This cooperation also allows polishing pad assemblies, and thus polishing pads, to be quickly and efficiently replaced without stopping the polishing process for an extended period of time. As such, the present invention allows the polishing process to continue for greater uninterrupted periods of time and thus increases the efficiency of the polishing process.

While the invention has been illustrated and described in detail in the drawings and foregoing description, such illustration and description is to be considered as exemplary and not restrictive in character, it being understood that only a preferred embodiment has been shown and described and that all changes and modifications that come within the spirit of the invention are desired to be protected.

What is claimed is:

1. An arrangement for polishing a surface of a semiconductor wafer, comprising:

a first polishing pad assembly which includes (i) a first support member having a first pad receiving surface and (ii) a first polishing pad attached to said first pad receiving surface;

an actuating mechanism for rotating said first polishing pad assembly when said first polishing pad assembly is coupled to said actuating mechanism;

a wafer carrier configured to receive and support said semiconductor wafer, said wafer carrier being positioned in an opposing relationship relative to said first pad receiving surface when said first polishing pad assembly is coupled to said actuating mechanism; and an attachment mechanism operatively linked to said actuating mechanism, said attachment mechanism being selectively operable between (i) a first coupling mode of operation and (ii) a decoupling mode of operation, wherein (i) when said attachment mechanism is operated in said first coupling mode of operation said first polishing pad assembly is (A) attached to said attachment mechanism and (B) coupled to said actuating mechanism and (ii) when said attachment mechanism is operated in said decoupling mode of operation said first polishing pad assembly is (A) detached from said attachment mechanism and (B) decoupled from said actuating mechanism.

2. The arrangement of claim 1, further comprising:

a second polishing pad assembly which includes (i) a second support member having a second pad receiving surface and (ii) a second polishing pad attached to said second pad receiving surface, wherein (i) said attachment mechanism is further selectively operable in a second coupling mode of operation, (ii) when said attachment mechanism is operated in said second coupling mode of operation said second polishing pad assembly is (A) attached to said attachment mechanism and (B) coupled to said actuating mechanism, and (iii) when said attachment mechanism is operated in said decoupling mode of operation said first polishing pad assembly and said second polishing pad assembly are (A) detached from said attachment mechanism and (B) decoupled from said actuating mechanism.

3. The arrangement of claim 1, wherein:

said first polishing pad has a diameter $D_1$, said semiconductor wafer has a diameter $D_2$, and $D_1<D_2$.

4. The arrangement of claim 1, wherein:

said attachment mechanism includes (i) a platen mechanically coupled to said actuating mechanism so that said actuating mechanism can rotate said platen, said platen having a vacuum surface defined thereon, said vacuum surface having a port defined therein and (ii) a vacuum pump in fluid communication with said port such that said vacuum pump can advance air through said port, said first support member has a platen receiving surface defined thereon, and said first support member is secured to said platen by a vacuum generated by said vacuum pump so that said platen receiving surface is facing toward said vacuum surface and said first pad receiving surface is facing away from said vacuum surface when said attachment mechanism is placed in said first coupling mode of operation.

5. The arrangement of claim 1, wherein:

said attachment mechanism includes a chuck mechanically coupled to said actuating mechanism, said first support member has a shaft secured thereto, and said shaft is mechanically coupled to said chuck when said attachment mechanism is placed in said first coupling mode of operation so that said actuating mechanism can rotate said first support member.

6. The arrangement of claim 1, wherein:

when said attachment mechanism is operated in said first coupling mode of operation said first polishing pad assembly is located vertically above said wafer carrier.

7. An arrangement for polishing a semiconductor wafer supported on a wafer carrier, comprising:

a first polishing pad assembly which includes (i) a first support member having a first pad receiving surface and (ii) a first polishing pad attached to said first pad receiving surface;

a second polishing pad assembly which includes (i) a second support member having a second pad receiving surface and (ii) a second polishing pad attached to said second pad receiving surface, an actuating mechanism for rotating at least one of said first polishing pad assembly and said second polishing pad assembly when said at least one of said first polishing pad assembly and said second polishing pad assembly is coupled to said actuating mechanism; and an attachment mechanism operatively linked to said actuating mechanism, said attachment mechanism being selectively operable between (i) a first coupling mode of operation, (ii) a second coupling mode of operation, and (iii) a decoupling mode of operation, wherein (i) when said attachment mechanism is operated in said first coupling mode of operation said first polishing pad assembly is (A) attached to said attachment mechanism and (B) coupled to said actuating mechanism, (ii) when said attachment mechanism is operated in said second coupling mode of operation said second polishing pad assembly is (A) attached to said attachment mechanism and (B) coupled to said actuating mechanism, and (iii) when said attachment mechanism is operated in said decoupling mode of operation said first polishing pad assembly and said second polishing pad assembly are (A) detached from said attachment mechanism and (B) decoupled from said actuating mechanism.

8. The arrangement of claim 7, wherein:

said first polishing pad and said second polishing pad each have a diameter $D_1$, said semiconductor wafer has a diameter $D_2$, and $D_1<D_2$.

* * * * *